US006419532B1

(12) United States Patent
Bradish, Jr.

(10) Patent No.: US 6,419,532 B1
(45) Date of Patent: Jul. 16, 2002

(54) JET-PROPELLED WATERCRAFT

(76) Inventor: Edward Bradish, Jr., 112 Fourth St., P.O. Box 105, Wyano, PA (US) 15695-0105

( * ) Notice: Subject to any disclaimer, the term of this patent is extended or adjusted under 35 U.S.C. 154(b) by 0 days.

(21) Appl. No.: 09/653,841

(22) Filed: Sep. 1, 2000

(51) Int. Cl.[7] ..... B63H 11/00; B63B 43/14

(52) U.S. Cl. ..... 440/38; 114/123

(58) Field of Search ..... 114/123, 121, 114/283, 345; 440/38, 42, 46, 88; D12/300

(56) References Cited

U.S. PATENT DOCUMENTS 4,287,624 A * 9/1981 Lowther ..... 114/343
4,625,674 A * 12/1986 Covington ..... 114/360
4,678,441 A * 7/1987 Murase ..... 440/88
4,781,141 A 11/1988 Webb et al.
4,964,821 A * 10/1990 Tafoya ..... 440/38
5,211,592 A 5/1993 Alkema
5,282,436 A * 2/1994 Hansen ..... 114/283
5,330,374 A 7/1994 Ishino
D357,223 S 4/1995 Thompson et al.
5,567,188 A * 10/1996 Allebosch ..... 440/38
5,577,941 A * 11/1996 Chartier ..... 440/46
5,634,831 A 6/1997 Davies et al.
5,788,547 A * 8/1998 Ozawa et al. ..... 440/89
5,794,556 A * 8/1998 Kobayashi ..... 114/123
5,934,953 A * 8/1999 Kobayashi ..... 440/38
5,997,373 A * 12/1999 Asai et al. ..... 440/89

* cited by examiner

*Primary Examiner*—S. Joseph Morano
*Assistant Examiner*—Andy Wright

(57) ABSTRACT

A jet-propelled watercraft for providing access to remote and shallow regions of water. The jet-propelled watercraft includes a hull structure having a floor, side walls, a bow, and a stern; and also including a seating assembly mounted upon the hull structure; and further including a watercraft-propelling assembly for propelling the hull structure upon water; and also including floatation members being attached to the hull structure.

1 Claim, 3 Drawing Sheets

JET-PROPELLED WATERCRAFT

BACKGROUND OF THE INVENTION

1. Field of the Invention

The present invention relates to a personal shallow water boat and more particularly pertains to a new jet-propelled watercraft for providing access to remote and shallow regions of water.

2. Description of the Prior Art

The use of a personal shallow water boat is known in the prior art. More specifically, a personal shallow water boat heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,330,374; U.S. Pat. No. 4,964,821; U.S. Pat. No. 5,634,831; U.S. Pat. No. 4,781,141; U.S. Pat. No. Des. 357,223; and U.S. Pat. No. 5,211,592.

While these devices fulfill their respective, particular objectives and requirements, the aforementioned patents do not disclose a new jet-propelled watercraft. The inventive device includes a hull structure having a floor, side walls, a bow, and a stern; and also including a seating assembly mounted upon the hull structure; and further including a watercraft-propelling assembly for propelling the hull structure upon water; and also including floatation members being attached to the hull structure.

In these respects, the jet-propelled watercraft according to the present invention substantially departs from the conventional concepts and designs of the prior art, and in so doing provides an apparatus primarily developed for the purpose of providing access to remote and shallow regions of water.

SUMMARY OF THE INVENTION

In view of the foregoing disadvantages inherent in the known types of personal shallow water boat now present in the prior art, the present invention provides a new jet-propelled watercraft construction wherein the same can be utilized for providing access to remote and shallow regions of water.

The general purpose of the present invention, which will be described subsequently in greater detail, is to provide a new jet-propelled watercraft which has many of the advantages of the personal shallow water boat mentioned heretofore and many novel features that result in a new jet-propelled watercraft which is not anticipated, rendered obvious, suggested, or even implied by any of the prior art personal shallow water boat, either alone or in any combination thereof.

To attain this, the present invention generally comprises a hull structure having a floor, side walls, a bow, and a stern; and also including a seating assembly mounted upon the hull structure; and further including a watercraft-propelling assembly for propelling the hull structure upon water; and also including floatation members being attached to the hull structure.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new jet-propelled watercraft which has many of the advantages of the personal shallow water boat mentioned heretofore and many novel features that result in a new jet-propelled watercraft which is not anticipated, rendered obvious, suggested, or even implied by any of the prior art personal shallow water boat, either alone or in any combination thereof.

It is another object of the present invention to provide a new jet-propelled watercraft which may be easily and efficiently manufactured and marketed.

It is a further object of the present invention to provide a new jet-propelled watercraft which is of a durable and reliable construction.

An even further object of the present invention is to provide a new jet-propelled watercraft which is susceptible of a low cost of manufacture with regard to both materials and labor, and which accordingly is then susceptible of low prices of sale to the consuming public, thereby making such jet-propelled watercraft economically available to the buying public.

Still yet another object of the present invention is to provide a new jet-propelled watercraft which provides in the apparatuses and methods of the prior art some of the advantages thereof, while simultaneously overcoming some of the disadvantages normally associated therewith.

Still another object of the present invention is to provide a new jet-propelled watercraft for providing access to remote and shallow regions of water.

Yet another object of the present invention is to provide a new jet-propelled watercraft which includes a hull structure having a floor, side walls, a bow, and a stern; and also including a seating assembly mounted upon the hull structure; and further including a watercraft-propelling assembly for propelling the hull structure upon water; and also including floatation members being attached to the hull structure.

Still yet another object of the present invention is to provide a new jet-propelled watercraft that prevents debris from damaging the boat in shallow water regions.

Even still another object of the present invention is to provide a new jet-propelled watercraft that is easy and convenient to use by all boat users.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
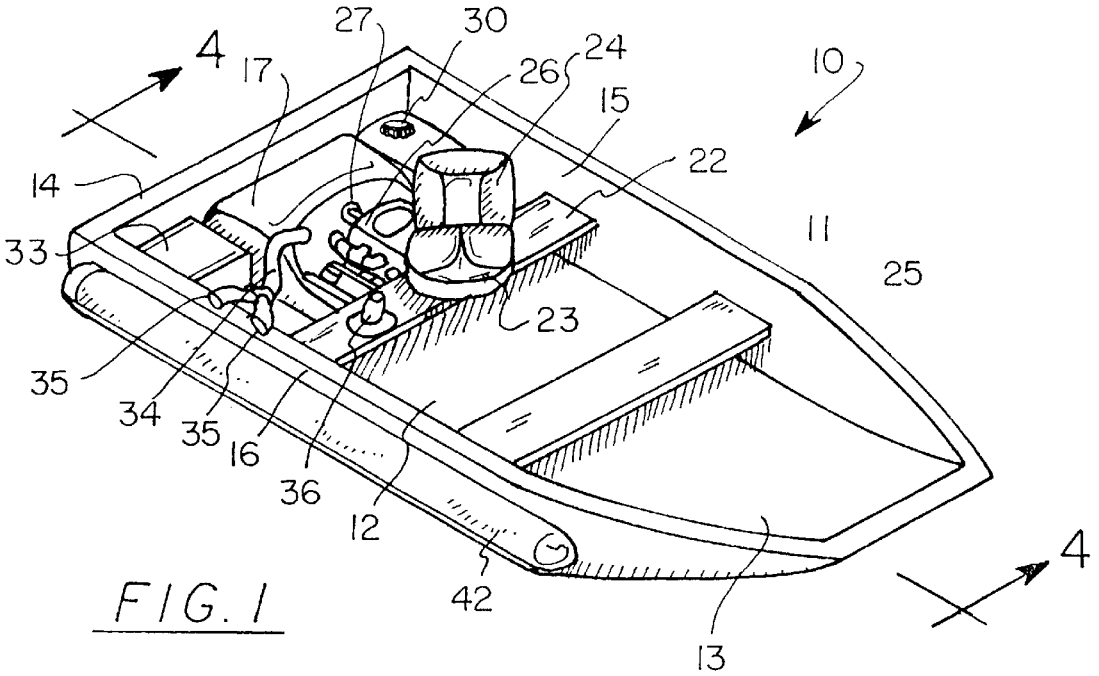
FIG. 1 is a top perspective view of a new jet-propelled watercraft according to the present invention.
Figure 4:
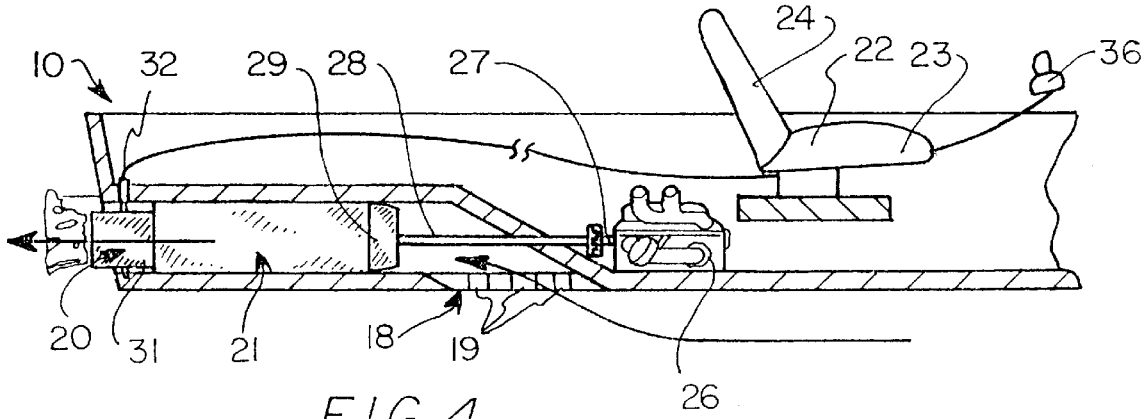
FIG. 4 is a cross-sectional view of the present invention.
Figure 2:
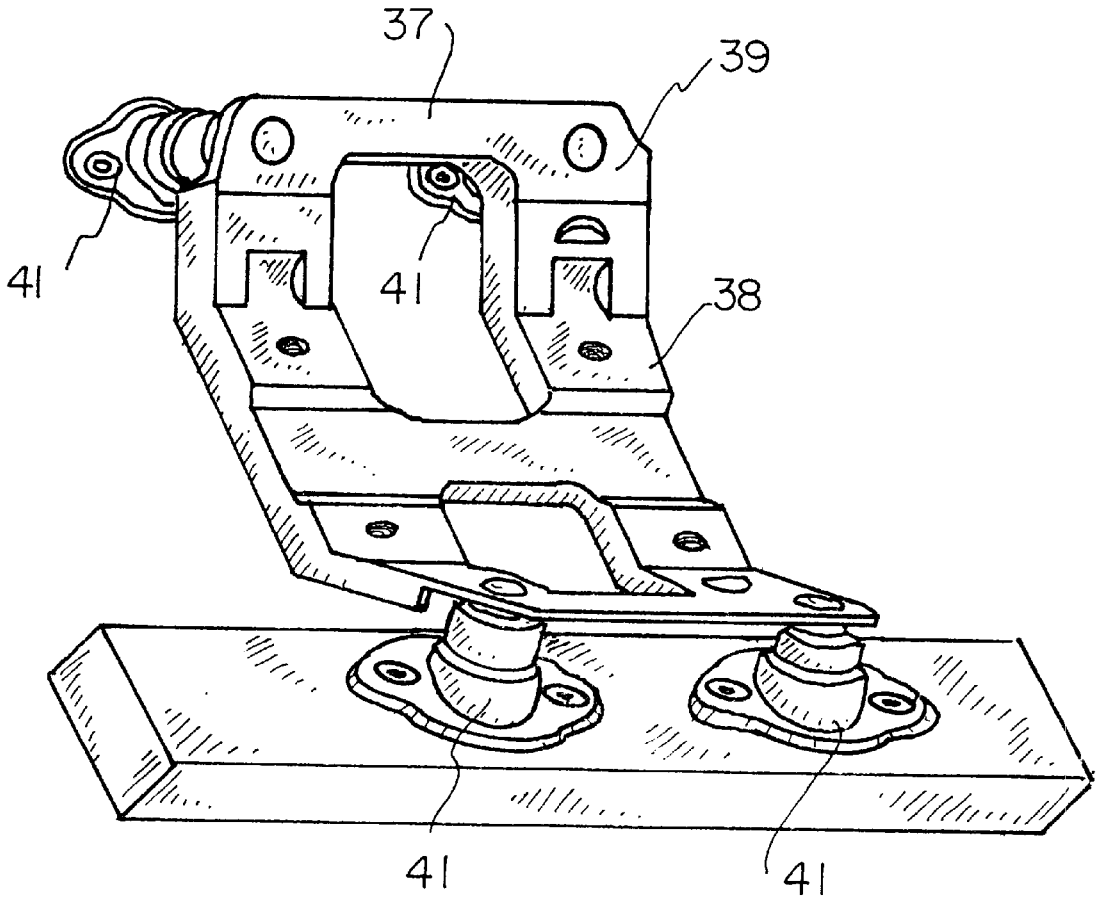
FIG. 2 is a detailed perspective view of the engine mounting bracket of the present invention.
Figure 5:
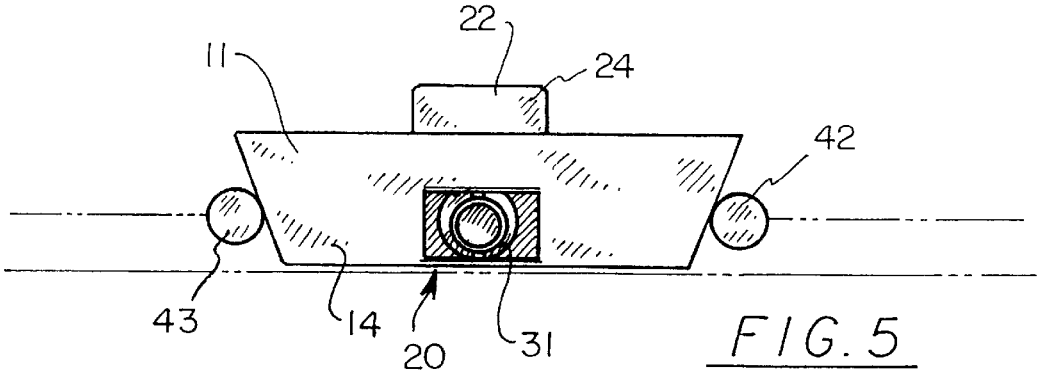
FIG. 5 is a rear elevational view of the present invention.
Figure 3:
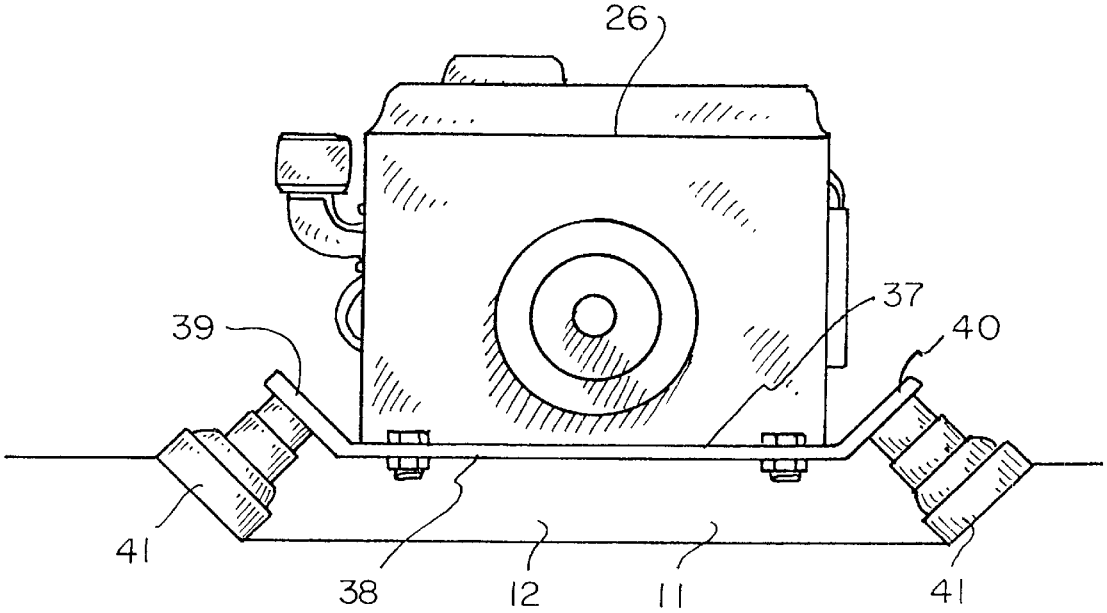
FIG. 3 is a detailed side elevational view of engine mounted to the engine mounting bracket of the present invention.

With reference now to the drawings, and in particular to FIGS. 1 through 5 thereof, a new jet-propelled watercraft embodying the principles and concepts of the present invention and generally designated by the reference numeral 10 will be described.

As best illustrated in FIGS. 1 through 5, the jet-propelled watercraft 10 generally comprises a hull structure 11 having a floor 12, side walls 15,16, a bow 13, and a stern 14. The hull structure 11 includes a water intake port 18 disposed in the floor 12 near the stern 14 and also includes an exhaust port 20 disposed in a wall of the stern 14. The hull structure 11 also includes a bulkhead structure 17 conventionally disposed upon the floor 12 at the stern 14 thereof and also includes a channel 21 disposed between the bulkhead structure 17 and the floor 12 and being connected to the water intake port 18 and the exhaust port 20. The hull structure 11 further includes a grate member 19 conventionally covering the water intake port 18.

A seating assembly 22–25 is conventionally mounted upon the hull structure 11 with the seating assembly 22–25 including bench seats 22,25 being spaced apart and being securely mounted upon the hull structure 11 and having ends which are securely and conventionally attached to the side walls 15,16 of the hull structure 11. At least one 22 of the bench seats includes a seat portion 23 and a backrest portion 24 being angled relative to the seat portion 23.

A watercraft-propelling assembly for propelling the hull structure 11 upon water includes an engine 26 having a motor shaft 27 rotatably attached to the engine 26, and also includes a drive shaft 28 conventionally coupled to the motor shaft 27 and extending through the bulkhead structure 17 into the channel 21, and further includes a turbine member 29 securely and conventionally attached at an end of the drive shaft 28 for forcing and propelling water through the exhaust port 20 which propels the watercraft 10; and also includes a tank 30 conventionally supported upon the hull structure 13 and being conventionally connected to the engine 26 for storing fuel for energizing the engine 26, and further includes a control member 36 being mounted upon one of the bench seats 22 and being essentially a lever and being connected to the engine 26 for energizing the engine 26 and for steering the hull structure 11, and also includes a nozzle assembly 31,32 pivotally disposed in the exhaust port 20 for maneuvering the hull structure 11, and further includes outlets 35 extending into the channel 21 for cooling the exhaust and the engine 26, and also includes a bilge 34 conventionally connected to the outlets 35 and to the engine 26, and further includes a battery 33 securely and conventionally supported upon the hull structure 11 and being connected to the engine 26 and to the control member 36. The watercraft-propelling assembly also includes a bracket assembly 37–41 for mounting the engine 26 to the hull structure 11. The bracket assembly 37–41 includes a bracket member 37 having a main portion 38 and end portions 39,40 which are angled relative to the main portion 38 with the bracket assembly 37–41 further including shock-absorbing members 41 securely and conventionally attached to the end portions 39,40 of the bracket member 37 and to the floor 12 of the hull structure 11 to cushion and stabilize the engine 26. The nozzle assembly 31,32 includes an axle member 32 conventionally connected to the bulkhead structure 17, and also includes a nozzle member 31 being securely and conventionally attached to the axle member 32 and extending rearwardly of the hull structure 11 through the exhaust port 20 for steering the hull structure 11 by directing the forced water therefrom.

Floatation members 42,43 are securely and conventionally attached to the hull structure 11 with each of the flotation members 42,43 including an elongate member being securely attached to an exterior of a respective side wall 15,16 and with the elongate member 42,43 essentially extending a length of the hull structure 11. Each of the floatation members 42,43 is essentially cylindrically-shaped.

In use, the user energizes the engine 26 using the control member 36, the fuel contained in the tank 30 and the battery 33. The user is able to steer the jet-propelled watercraft 10 in shallow waters by pivoting the nozzle member 31 which directs the forced intake water in the desired direction in order to move the jet-propelled watercraft 10 upon the water.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A jet-propelled watercraft comprising:

a hull structure having a floor, side walls, a bow, and a stern, each of said side walls having an upper edge and a lower edge extending from the bow to the stern of said hull structure, said hull structure including a water intake port disposed in said floor near said stern and also including an exhaust port disposed in a wall of said stern, said hull structure including a bulkhead structure disposed upon said floor at said stern thereof and also including a channel disposed between said bulkhead structure and said floor and being connected to said water intake port and said exhaust port, said hull structure including a grate member covering said water intake port;

a seating assembly mounted upon said hull structure, said seating assembly including bench seats being spaced apart and being securely mounted upon said hull structure and having ends which are securely attached to said side walls of said hull structure, at least one of said bench seats including a seat portion and a backrest portion being angled relative to said seat portion;

a watercraft-propelling assembly for propelling said hull structure upon water, said watercraft-propelling assembly including an engine having a motor shaft rotatably attached to said engine, and also including a drive shaft coupled to said motor shaft and extending through said bulkhead structure into said channel, and further including a turbine member securely attached at an end of said drive shaft; and also including a tank supported upon said hull structure and being connected to said engine for storing fuel for energizing said engine; and further including a control member mounted upon one of said bench seats and being connected to said engine; and also including a nozzle assembly pivotally disposed in said exhaust port for maneuvering said hull structure; and further including outlets into said channel for cooling exhaust and said engine; and also including a bilge connected to said outlets; and further including a battery securely supported upon said hull structure and being connected to said engine and to said control member, said watercraft-propelling assembly also including a bracket assembly for mounting said engine to said hull structure, said bracket assembly including a bracket member having a main portion and end portions which are angled relative to said main portion, said bracket assembly further including shock-absorbing members securely attached to said end portions of said bracket member and to said floor of said hull structure to cushion and stabilize said engine, said nozzle assembly including an axle member connected to said bulkhead structure, and also including a nozzle member being securely attached to said axle member and extending rearwardly of said hull structure through said exhaust port for steering said hull structure; and floatation members attached to said hull structure, each of said floatation members being mounted on one of said side walls of said hull structure, each of said floatation members being located on one of said side walls at a location spaced away from said lower edge toward said upper edge of said side wall such that increasing a draft of said hull structure increases a draft of said flotation members, each of said floatation members being elongate and substantially cylindrically shaped for facilitating movement of said floatation members through air and water during forward movement of said hull structure;

wherein each of said side walls has a bend located toward the bow of said hull structure, each of said flotation members extending from the stern of said hull structure to the bend in the side wall of said hull structure;

wherein a forward end of each of said floatation members is rounded for facilitating movement of said forward end through air and water; and wherein each of said floatation members has a substantially uniform cross-sectional shape from the forward end of said floatation member to a rearward end of said floatation member.

* * * * *